United States Patent [19]

Tratiner

[11] 3,970,888

[45] July 20, 1976

[54] TUNGSTEN-THORIUM DIOXIDE-ALUMINUM OXIDE MASS FOR A HIGH-TEMPERATURE-RESISTANT EMISSION ELECTRODE AND PROCESS FOR THE PRODUCTION THEREOF

[75] Inventor: Hermann Trattner, Munich, Germany

[73] Assignee: Siemens Aktiengesellschaft, Berlin & Munich, Germany

[22] Filed: July 23, 1974

[21] Appl. No.: 491,040

[30] Foreign Application Priority Data

July 23, 1973 Germany ..... 2337344

[52] U.S. Cl. ..... 313/346 R; 29/25.17; 252/500; 313/311

[51] Int. Cl.[2] ..... H01J 1/14; H01J 19/06

[58] Field of Search ..... 313/311, 346; 347/77; 252/500; 29/25.17

[56] References Cited

UNITED STATES PATENTS

| | | | |
|---|---|---|---|
| 3,134,924 | 5/1964 | Henderson et al. | 313/346 R |
| 3,244,929 | 4/1966 | Kuhl | 313/346 R |
| 3,706,001 | 12/1972 | Nall | 313/311 |
| 3,798,490 | 3/1974 | Dunham et al. | 313/311 |
| 3,798,492 | 3/1974 | Menelly | 313/346 |

*Primary Examiner*—Saxfield Chatmon, Jr.
*Attorney, Agent, or Firm*—Hill, Gross, Simpson, Van Santen, Steadman, Chiara & Simpson

[57] ABSTRACT

A mass for emission electrodes and the like operating at high temperatures, employing a mixture of thorium dioxide and aluminum oxide, which contains tungsten, the thorium dioxide being present from 33–50% by weight, and the aluminum oxide from 4–15%, to which mixture is added 63–35% of tungsten powder, the powdered tungsten preferably being imbedded in a crystalline melt of thorium dioxide and aluminum dioxide, and a method of producing the same.

15 Claims, 7 Drawing Figures

TUNGSTEN-THORIUM DIOXIDE-ALUMINUM OXIDE MASS FOR A HIGH-TEMPERATURE-RESISTANT EMISSION ELECTRODE AND PROCESS FOR THE PRODUCTION THEREOF

BACKGROUND OF THE INVENTION

The invention is directed to a mass for an emission electrode which is to be operated at a high temperature, in which the mass comprises a power mixture of thorium dioxide and aluminum oxide, and to a method for the production of such a mass.

German OS No. 1 589 111 discloses an electrode for electron tubes, which comprises a tungstem rod, to which is added thorium dioxide. It is also provided with a heating coil, likewise formed from tungsten, which is operatively to suitably heat the electrode. To facilitate the emission of the electrons, the tip of the tungsten rod and the coil are coated with a mixture of thorium dioxide powder and thorium powder, a bonding agent being employed to enable such powder mixture to adhere to the focal spot of the electrode. The powder deposit is then transformed, by means of an arc discharge at approximately 2000°C, to form a ceramic mass which then firmly adheres to the tungsten wire and to the electrode pin. The bonding agent employed evaporates when the coating mass fuses. Such coating mass has a relatively good electron emission capacity but, in contrast to other previously known electrodes for tubes, has a relatively low mechanical stability. Tungsten when mixed with thorium dioxide and thorium is extremely brittle, such brittleness increasing with the quantity of thorium added to the tungsten. Likewise, the bonding strength and stability of a mixture composed of thorium and thorium oxide may be subjected to only a limited thermal load. If the temperature rises to above the melting point of thorium (1845°C) the mass will readily become molten and a dripping of the electrode material will take place. Further, in the solid state the mass has a very smooth and flat surface structure.

Additionally, German Pat. No. 1 806 856 discloses a non-fusible electrode comprising tungsten with thorium additives for use in so-called tungsten inert gas welding (TIG). In order to increase the electron-emission capacity, such electrode is provided with a coating layer of thorium dioxide, which is applied to the electrode tip by fuse-sintering. In effecting such operation, the tip of the electrode is first coated with thorium dioxide powder and is then slowly heated until the thorium dioxide melts. Thereupon, at an initially low current value, an arc is ignited and then by increasing the electrode distance and greatly increasing the current to well above the normal operating range of the electrode, the thorium dioxide is sintered onto the surface of the electrode tip. Coating layers of this type also have a good electron-emission capacity.

Although such electrodes have proved valuable in actual practice, they are extremely sensitive to mechanical loads, for example, such as may readily occur during welding in the event of contact with the workpiece, whereby the mass falls out and the electrode becomes unserviceable.

In the above referred to patent, it is proposed that other metal oxide be added to the coating mass, in this instance of thorium dioxide, to facilitate the sintering process. For this purpose there is employed a metal oxide whose melting point is at a considerably lower temperature than the thorium dioxide. However, it has been proven that when such metal oxides are employed, either the mechanical and/or the thermal load capacity, as well as the electron-emission capacity will drop. The two metal oxides form an eutectic so that even when the electrode is subject to a slight overload, as previously described, the mass becomes molten, resulting in the electrode failing practically at a single stroke.

BRIEF SUMMARY OF THE INVENTION

The invention thus is directed to the production of a mass of the type previously referred to, for use as an electrode to be operated at high temperature which, in addition to a high electron-emission capacity, also possesses good stability at high operating temperatures of the electrode. These requirements are fulfilled in a mass, in accordance with the invention, which comprises 33–50%, by weight, thorium dioxide, 4–15% aluminum oxide, and 63–35% tungsten powder with the latter being additionally added to the mixture of thorium dioxide and aluminum dioxide.

In producing such an electrode mass, in accordance with the invention, such mass, preferably along with its high-temperature-resistant carrier body, is heated to at least the eutectic temperature of the thorium dioxide-aluminum oxide mixture (1900°C), preferably to 2100°C, following which the melt so formed, containing tungsten powder, is allowed to solidify, with the time required for the melt to solidify being kept equal to or shorter than that corresponding to the subsequent operating conditions of the emission electrode, i.e. cooling period following operation.

An electrode produced from such a mass, in accordance with the method described, possesses not only a high electron emission capacity but also a good thermal and mechanical load capacity. The addition of the tungsten powder to the mass provides the latter with a relatively good stability at high temperatures.

The mass, composed of the aforesaid metal oxide, is transformed into its molten phase when the relatively high eutectic temperature is reached, but the tungsten contained in the melt prevents the mass from dripping. Instead, the mass is in a sticky, pasty state or form which changes very, little even when the electrode is subjected to high thermal overloads. Even when subjected to normal vibrations, the mass adheres firmly to its carrier body.

One surprising feature of the invention is that due to the high proportion of the tungsten powder in the overall mass, it would initially be expected that the electron emission capacity which is fundamentally determined by the two metal oxides would be reduced but, as a matter of actual practice, it is scarcely altered and in fact is even improved. This is due to the fact that, on the one hand, when the melt cools, portions thereof are precipitated as crystals, and on the other hand, the high proportion of tungsten powder results in the surface of the melt assuming a particularly rough character. Thus, as a result of the tip discharge and increased surface area, the electron emission capacity is substantially improved, in particularly on the ignition of the electrode, i.e. from out of the cold state.

It is important in the production of the mass that the cooling time should be no longer than the cooling time involved under normal operating conditions. If the cooling time is too long, larger crystals will be formed within the mass, and upon operation of the electrode it may then occur, in particular if the eutectic temperature is not reached, that the crystals will disintegrate. The mass thereby loses its internal structure and can then, even when the electrode is in the cold state, easily drop out when subjected to an impact or blow.

The mass is particularly suitable for the production of electrode bodies, e.g. in the form of a mass embedded in an electrode composed of tungsten, such as used in tungsten-inert-gas welding and in plasma welding. The mass also is well suited for embedding into grooves or cavities in an electrode body formed from ceramic material. Electrodes of this type have particular application as emission electrodes for electron beam guns as well as for X-ray tubes and the like.

BRIEF DESCRIPTION OF THE DRAWINGS

In the drawings wherein like reference characters indicate like or corresponding parts.

DETAILED DESCRIPTION OF THE INVENTION

Figure 1:
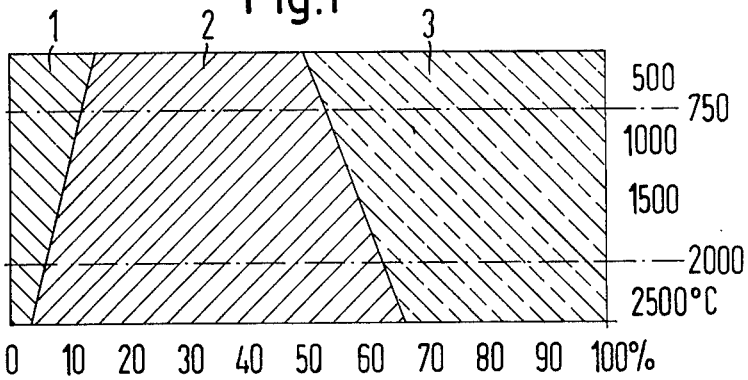
FIG. 1 is a proportional diagram illustrating the proportions of the materials involved in dependence upon the temperature of the emission electrode in which the material is to be employed.

Referring to FIG. 1, the diagram illustrates the individual powdered components of the mixture, reference numeral 1 designating the aluminum oxide, reference numeral 2 the tungsten, and reference numeral 3 the thorium dioxide, which are depicted in dependence upon the specific operating temperature at which the electrode is to be employed. The percentages are so selected that at the expected specific operating temperature the electrode, the mass, together with its carrier body, exhibits not only an optimum electron emission capacity but also a corresponding thermal and mechanical stability, as well as operating reliability.

If, for example, the emission electrode is to operate at a temperature of 2000°C, in order to avoid the disadvantages of the prior structures, for example mass dripping, etc., the proportion of tungsten will be selected as high as possible, in the example under consideration 53% by weight, the thorium dioxide 40% by weight and the proportion of aluminum oxide 7% by weight. If, however, the emission electrode is to operate only at 1000°C, the component proportions of the mixture of the overall mass preferably will correspond to those previously specified, i.e. 44%, 45% and 11%.

As previously mentioned, the thorium dioxide will range from 33–50% by weight, the aluminum oxide 4–15% by weight, and tungsten 63–35% by weight.

Following mixing of the components, the mixture is provisionally applied to the carrier body in known manner, for example, by pressure, adhesion, sintering or plugging. In dependence upon the purpose for which the electrode is to be employed, the mass, together with the carrier body, is heated to at least the eutectic temperature of the thorium dioxide-aluminum oxide (1950°), preferably however, to above the melting temperature of the metal oxide having the highest melting point, in this case aluminum oxide (2050°C), with the heating thus extending to 2100°C to 2200°C. The eutectic, and possibly any excess portion of the aluminum oxide thus becomes molten. The heating of the carrier body with the mass may be carried out either in an arc or by igniting an arc, or by resistance heating, individually in a high temperature furnace lined with magnesium oxide muffles.

As previously explained, it is important that the initial cooling of the carrier body with the melt take place in accordance with the subsequent operating conditions, i.e. cooling of the carrier body when in use.

Figure 2:
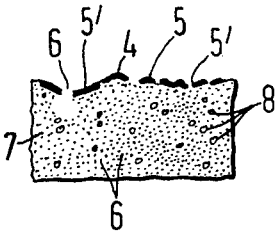
FIG. 2 illustrates a polished section of a fuse-sintered mass produced in accordance with the invention.

FIG. 2 is a graphic representation, on a very large scale, of a polished section of a fuse-sintered mass 7, in the region adjacent the surface 4 thereof, and in which the light points appear dark in the polished section. The surface of the mass is rough as a result of the tungsten 8 contained in the mass and clearly exhibits elevations 5 and recesses 5'. The crystals 6 are clearly visible in the mass, these possessing different sizes in dependence upon the cooling speed of the melt. The minimum surface roughness for suitable electron emission capacity of the mass is 100 $\mu$m.

Figure 3:
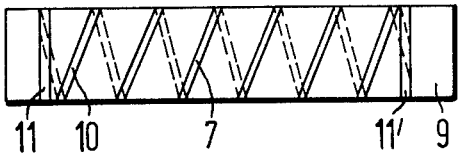
FIG. 3 is a side elevational view of a ceramic body carrying the emission material of the present invention.
Figure 4:
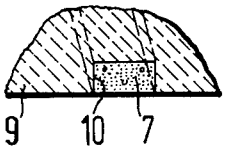
FIG. 4 is a longitudinal sectional view through one of the grooves formed in the structure illustrated in FIG. 3.

FIGS. 3 and 4 illustrate a ceramic body 9 provided with a helically shaped groove 10 which is coated with an adhesive prior to introduction therein of the powdered mass, for example, by rolling the body in the mass. The body 9 is then heated to approximately 2000°C in a furnace lined with magnesium oxide muffles whereupon the fuse-sintering process of the mass commences. In the operation, the adhesive evaporates and the mass is sintered to the ceramic material. Contacting the electrode may be effected at the portions 11 and 11' of the mass. Electrodes of this type can, for example, be utilized in place of tungsten coiled electrodes as emission electrodes in electron beam guns.

Figure 5:
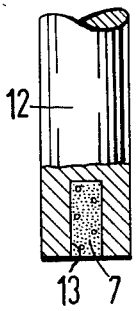
FIG. 5 illustrates, on a larger scale, the tip of a welding electrode having an insert of material produced in accordance with the present invention.

FIG. 5 illustrates, on a larger scale, the tip of a welding electrode 12 formed from tungsten, which may be inserted into an arc forming electrode of the type employed in tungsten-inert-gas welding or plasma welding. The electrode illustrated has a cavity 13 in which the mass 7 is embedded, with the fuse sintering of the mass being effected by igniting an arc and heating the electrode tip to well above its normal temperature range when in operation. If, during the operation of the welding electrode, the eutectic contained in the mass again becomes molten, which will occur when the electrode is subjected to a high current load, the high proportion of tungsten will insure that the mass remains in a sticky, paste-like state, so that the mass is effectively retained in the cavity of the carrier body and the welding electrode.

Figure 6:
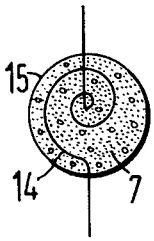
FIG. 6 is a plan view of an electrode body constructed in accordance with the present invention with the mass applied to a tungsten wire.
Figure 7:
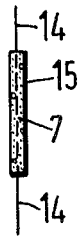
FIG. 7 is a side elevational view of the structure illustrated in FIG. 6.

FIGS. 6 and 7 illustrate an electrode body composed of a mass 7, in the form of a generally circular disc, which is pressed upon a tungsten wire, wound for example in the form of a spiral 15, or in the form of a wire coil. The pressure on the disc can be accompanied with application of an adhesive thereto. It is also possible, however, to pre-temper the carrier body, in the instant case the wire 14, with the disc and then to fuse-sinter it. Such fuse-sintering may likewise be effected in a furnace lined with magnesium oxide muffles. Emission electrodes of this type, here shown on an enlarged scale, can in particular be used in electron beam generators such as picture tubes, X-ray tubes, electron beam guns and the like.

Having thus described my invention it will be obvious that although various minor modifications might be suggested by those versed in the art, it should be understood that I wish to embody within the scope of the patent granted hereon all such modifications as reasonably, and properly come within the scope of my contribution to the art.

I claim as my invention:

1. A mass for emission electrode operating at a high temperature, comprising a mixture of thorium dioxide and aluminum oxide to which is added tungsten powder, with such components being present in the following proportions:

| | |
|---|---|
| thorium dioxide | 33–50% |
| aluminum oxide | 4–15% |
| tungsten powder | 63–35%. |

2. A mass according to claim 1, wherein the mass is fuse-sintered to an electrode body, preferably formed from tungsten or thoriated tungsten.

3. A mass according to claim 1, wherein the mass is embedded in a welding electrode composed of tungsten or thoriated tungsten.

4. A mass according to claim 1, wherein the mass is fuse-sintered on the heating coil of tungsten.

5. A mass according to claim 1, wherein the mass is fuse-sintered on an electron-emission electrode of an electron beam gun or x-ray tube.

6. A mass according to claim 1, wherein the mass is fuse-sintered to a carrier body of ceramic material provided with a groove in which the mass is disposed.

7. A mass according to claim 1, wherein the thorium dioxide and aluminum oxide is in the form of a crystalline melt in which the powdered tungsten is embedded.

8. A mass according to claim 7, wherein the surface roughness of the crystalline, solidified melt formed from thorium dioxide and aluminum and the containing tungsten powder, is greater than 100 $\mu$m.

9. A mass according to claim 7, wherein the mass is fuse-sintered to an electrode body, preferably formed from tungsten or thoriated tungsten.

10. A mass according to claim 7, wherein the mass is embedded in a welding electrode composed of tungsten or thoriated tungsten.

11. A mass according to claim 7, wherein the mass is fuse-sintered on the heating coil of tungsten.

12. A mass according to claim 7, wherein the mass is fuse-sintered on an electron-emission electrode of an electron beam gun or x-ray tube.

13. A mass according to claim 7, wherein the mass is fuse-sintered to a carrier body of ceramic material provided with a groove in which the mass is dispcsed.

14. A method for the production of a mass containing thorium dioxide and aluminum oxide for an emission electrode having a high temperature resistant carrier body which accommodates the mass and to which the mass is fuse-sintered at a high temperature, comprising the steps of mixing the aluminum oxide with the thorium dioxide, and adding tungsten powder to such mixture with said mass comprising 33–50% by weight thorium dioxide, 4–15% aluminum oxide, and 63–35% tungsten, heating said mass to at least above the melting point of the thorium dioxide-aluminum oxide eutectic (1950°C), permitting the melt so formed containing tungsten powder to solidify, with the time required for solidification of the melt being kept equal to or shorter than that corresponding to subsequent cooling conditions arising in the operation of the emission electrode.

15. A method according to claim 9, wherein the mass is heated to 2100°C.

* * * * *